US005682938A

United States Patent [19]

Hsu

[11] Patent Number: 5,682,938

[45] Date of Patent: Nov. 4, 1997

[54] OPERATING STRUCTURE FOR A VERTICAL BLIND

[75] Inventor: Peyson Hsu, Changhua Hsien, Taiwan

[73] Assignee: Ching Feng Blinds Ind., Co., Ltd., Changhua Hsien, Taiwan

[21] Appl. No.: 596,748

[22] Filed: Feb. 5, 1996

[51] Int. Cl.[6] ..... E06B 9/30

[52] U.S. Cl. ..... 160/168.1 V; 160/173 V; 160/177 V; 160/178.1 V

[58] Field of Search ..... 160/168.1 V, 173 V, 160/174 V, 176.1 V, 177 V, 178.1 V, 900

[56] References Cited

U.S. PATENT DOCUMENTS

| | | | |
|---|---|---|---|
| 4,291,738 | 9/1981 | Grenga et al. | 160/176.1 V |
| 4,813,469 | 3/1989 | Scott | 160/900 X |
| 4,844,139 | 7/1989 | John | 160/168.1 V |
| 4,936,369 | 6/1990 | Darner | 160/900 X |
| 5,038,843 | 8/1991 | Sommerfield | 160/176.1 V X |
| 5,095,966 | 3/1992 | Rogers | 160/900 X |
| 5,103,889 | 4/1992 | Ford | 160/177 V |
| 5,465,779 | 11/1995 | Rozon | 160/168.1 V |
| 5,476,132 | 12/1995 | Jacobson | 160/168.1 V |

*Primary Examiner*—Kenneth J. Dorner
*Assistant Examiner*—Bruce A. Lev
*Attorney, Agent, or Firm*—Browdy and Neimark

[57] ABSTRACT

An operating structure for a vertical blind, which is used to adjust the angle of the slats and collect the slats, including an operative pulley seat, a guide cord, a shaft wheel, a hollow pull rod, a latch hook, an upper cock body, a lower cock body, an adjustment block, two conic sleeves, a screw, a hollow rotary bar and a distance-adjusting strip.

1 Claim, 6 Drawing Sheets

OPERATING STRUCTURE FOR A VERTICAL BLIND

BACKGROUND OF THE INVENTION

The present invention relates to an operating structure for a vertical blind, in which the slats of the blind can be easily collected without being damaged even in the case that the slats are not face-to-face positioned. In addition, the angle of the slats can be easily adjusted to open or close the blind.

FIG. 1 shows a conventional operating structure for a vertical blind, which includes an operative pulley seat 1, an adjustment bar 4, a hollow rotary rod 6 and a distance adjusting strip 7. An ohm set 2 is disposed in the pulley seat 1 and a hanging hook 3 extends downward from the ohm set 2 from the lower side of the pulley seat 1. A ring member 5 is disposed on the top end of the adjustment bar 4.

Referring to FIG. 2, the hollow rotary rod 6 is passed through the rotary rod holes formed on two sides of the ohm set 2 and the distance adjusting strip 7 is fitted into the distance adjusting slots formed on two sides of the pulley seat 1. The ring member 5 of the adjustment bar 4 is hung on the hanging hook 3 under the pulley seat 1. The hollow rotary rod 6 is further passed through the rotary rod holes of the ohm sets 2 of all other pulley seats 1'. A slat 9 is clipped by a clip member 8 of each ohm set 2. Two ends of the hollow rotary rod 6 are rotatably secured at two ends of an upper beam 9'. When rotating the slats 9, the adjustment bar 4 is first rotated. At this time, the ring member 5 of the adjustment bar 4 rotarily drives the hanging hook 3 so as to rotate the ohm set 2. In turn, the hollow rotary rod 6 is rotated to rotate the slats 9 by a desired angle. When collecting the slats 9, the slats 9 are first rotated to a position normal to the window by the adjustment bar 4 and then the adjustment bar 4 is pushed or pulled to move the pulley seat 1 so as to push other pulley seats 1' in a collecting direction for collecting the slats 9. When spreading the slats 9, the adjustment bar 4 is reversely pushed or pulled.

Three shortcomings exist in the above conventional arrangement as follows:

1. When collecting the slats 9, the slats 9 must be first rotated to a face-to-face position normal to the window by means of the adjustment bar 4 and then the adjustment bar 4 is pushed or pulled in a collecting direction in order to collect the slats 9. This procedure is quite troublesome.

2. When collected, in case the slats 9 are not in the face-to-face position and are positioned side by side as shown by phantom lines of FIG. 2, a slat may be inserted into the clip member 8 of an adjacent pulley seat to affect the collecting operation or be damaged.

3. A user can hardly judge in which direction the adjustment bar 4 should be rotated in order to open or close the blind.

SUMMARY OF THE INVENTION

It is therefore a primary object of the present invention to provide an operating structure for a vertical blind, in which the slats can be collected without being first rotated to a face-to-face position. This is achieved by an operating structure that permits holding the adjustment block and pulling the same in a collecting direction, wherein the slats are automatically rotated to a face-to-face position and collected. In such procedure, the guide cord is prevented from being tangled with an adjacent slat.

It is a further object of the present invention to provide the above operating structure in which when collected, the slats of the blind are automatically rotated to a face-to-face position to prelude, a slat being inserted into a clip member of an adjacent pulley seat to affect the collecting operation or damage the slot.

It is still a further object of the present invention to provide the above operating structure in which the angle of the slats can be easily and quickly adjusted to open or close the blind by means of pulling the adjustment block or any of two conic sleeves.

The present invention can be best understood through the following description and accompanying drawings, wherein:

DETAILED DESCRIPTION OF THE PREFERRED EMBODIMENT

Figure 1:
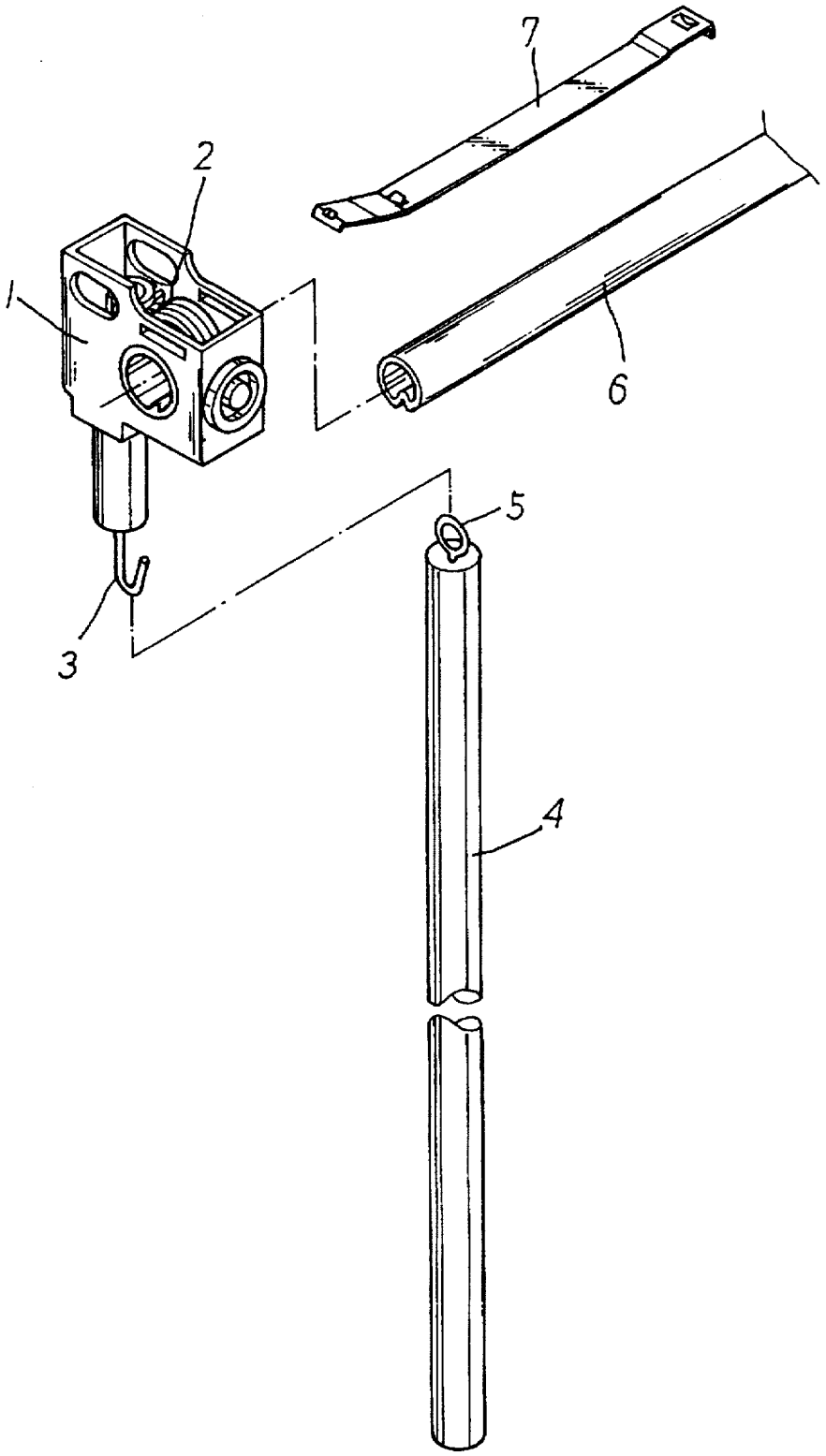
FIG. 1 (PRIOR ART)
FIG. 1 is a perspective exploded view of a conventional operating structure for a vertical blind.
Figure 2:
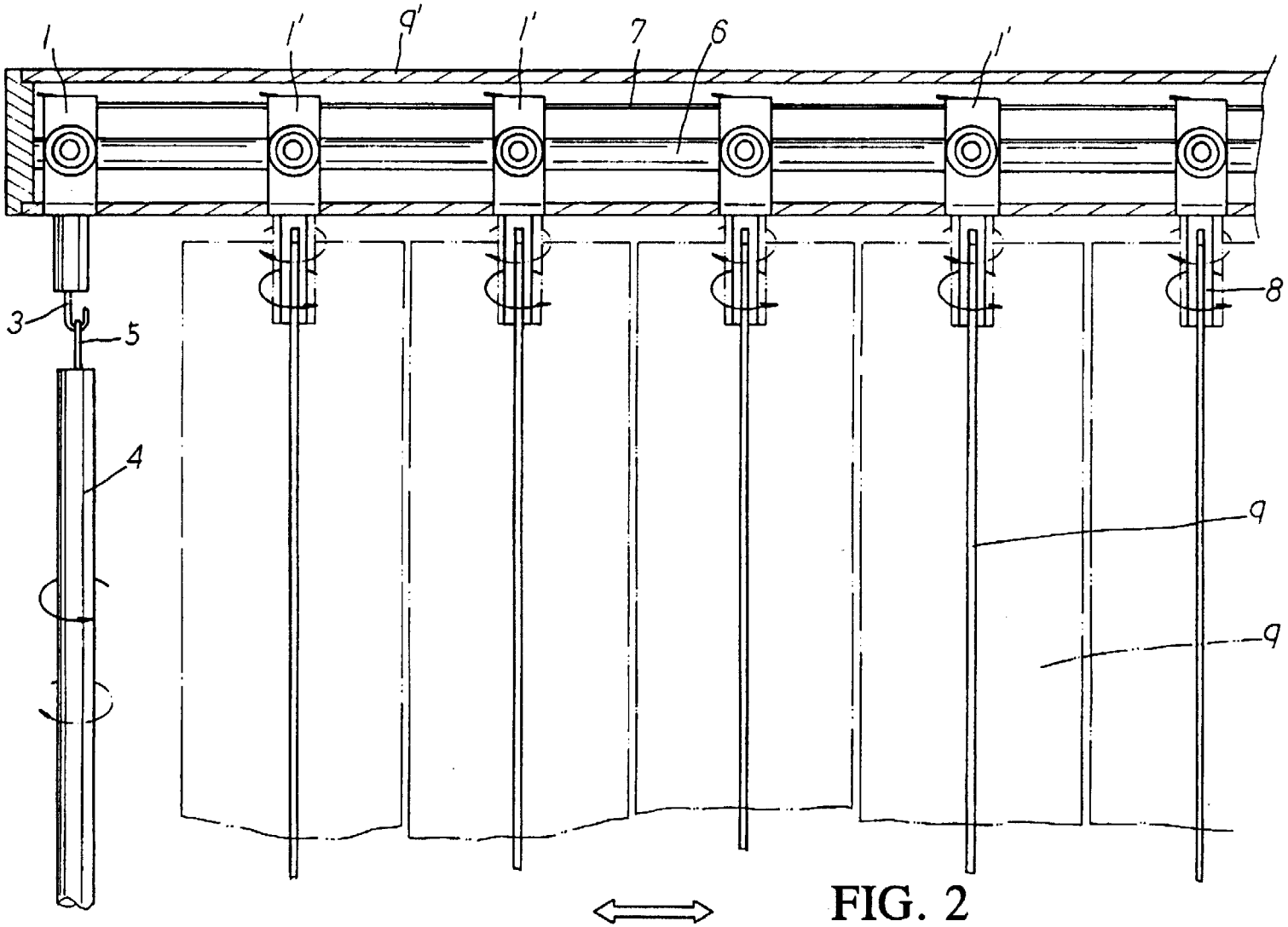
FIG. 2 (PRIOR ART)
FIG. 2 is an assembled view of the conventional operating structure, showing the operation thereof.
Figure 3:
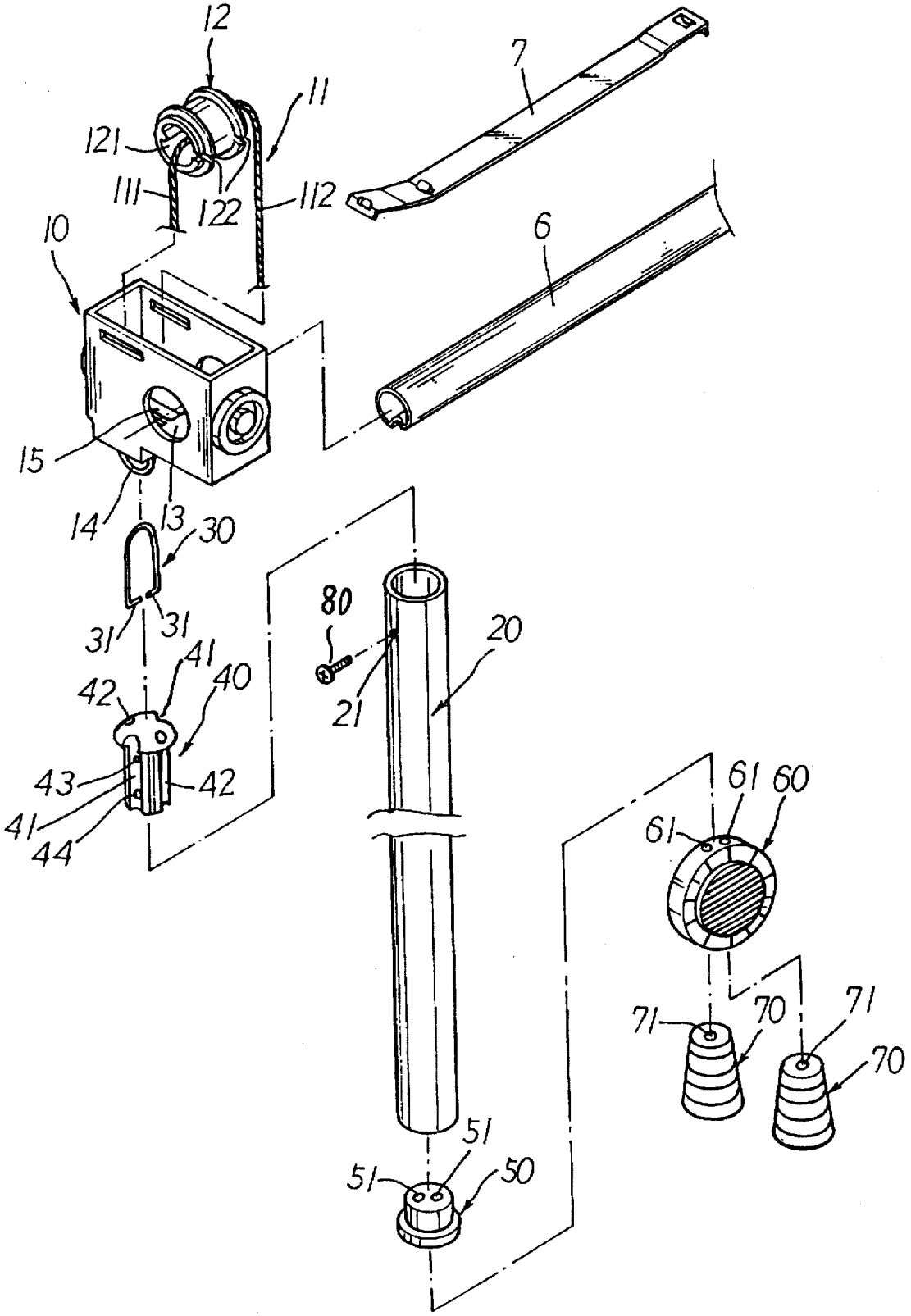
FIG. 3 is a perspective exploded view of the present invention.

Please refer to FIG. 3. The present invention mainly includes an operative pulley seat 10, a guide cord 11, a shaft wheel 12, a hollow pull rod 20, a latch hook 30, an upper cock body 40, a lower cock body 50, an adjustment block 60, two conic sleeves 70, a screw 80, a hollow rotary bar 6 and a distance-adjusting strip 7. A pair of shaft wheel holes 13 are respectively disposed on two sides of the operative pulley seat 10. A hook ring 14 and two through holes 15 are formed on a rear side of a bottom of the operative pulley seat 10. The shaft wheel 12 is formed with a central rotary bar hole 121 and two opposite fissures 122 on two sides. A locking hole 21 is formed on upper end portion of the hollow pull rod 20. The latch hook 30 is substantially U-shaped, having two inward bent latch legs 31 at two ends. The upper cock body 40 is mushroom-shaped, having a head portion and a stem portion. The stem portion is formed with two opposite latch hook channels 41 and two opposite guide cord channels 42. The latch hook channels 41 extend upward to the head portion and the guide cord channels 42 extend upward through the head portion. A latch hole 43 and a fixing hole 44 are formed through the stem portion between the opposite latch hook channels 41. The lower cock body 50 is reverse T-shaped, having two guide cord through holes 51 on the top face. The adjustment block 60 is formed with two radial through holes 51. Each conic sleeve 70 has a closed top end formed with a circular hole 71 and an open bottom end.

Figure 4:
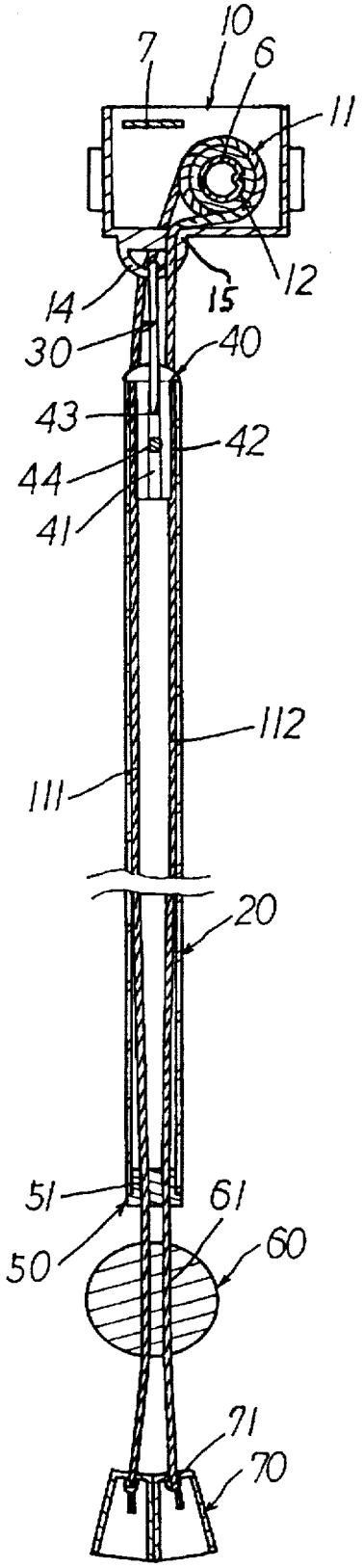
FIG. 4 is a is a side sectional assembled view of the present invention.

Please refer to FIG. 4. When assembled, the guide cord 11 is passed through the rotary bar hole 121 of the shaft wheel 12 to a certain length (about at the middle portion of guide cord 11) and then a first and a second end portions 111, 112 of the guide cord 11 are engased in the fissures 122 of the shaft wheel 12. The guide cord 11 is further wound on the shaft wheel 12 by several circles. Two ends of the shaft wheel 12 are then rotatably fitted into the shaft wheel holes 13 of the pulley seat 10. The first and second end portions 111, 112 of the guide cord 11 are respectively sequentially passed through the through holes 15 of the pulley seat 10, the guide cord channels 42 of the upper cock body 40, the hollow pull rod 20, the guide cord holes 51 of the lower cock body 50, the through holes 61 of the adjustment block 60 and the circular holes 71 of the conic sleeves 70. Then the first and second end portions 111, 112 of the guide cord 11 are knotted and prevented from being withdrawn from the conic sleeves 70. The latch hook 30 is then hooked on the hook ring 14 of the pulley seat 10 with the bent latch legs 31 fitted into the latch hole 43 of the upper cock body 40. Then the upper cock body 40 is fitted into the upper end of the pull rod 20 with the fixing hole 44 aligned with the locking hole 21 thereof. The screw 80 is screwed through the locking hole 21 into the fixing hole 44 of the upper cock body 40 so that the upper cock body 40 is secured in the upper end of the pull rod 20 and spaced from the hook ring 14 by a short distance so as to avoid tangling of adjacent slats 9 during rotation. Then the periphery of the lower cock body 50 is painted with an adhesive and fixedly plugged into the lower end of the pull rod 20. Then the rotary bar 6 is passed through the rotary bar hole 121 of the shaft wheel 12 and the distance adjusting strip 7 is fitted into the distance adjusting slots of the pulley seat 10 to complete the assembly.

Figure 5:
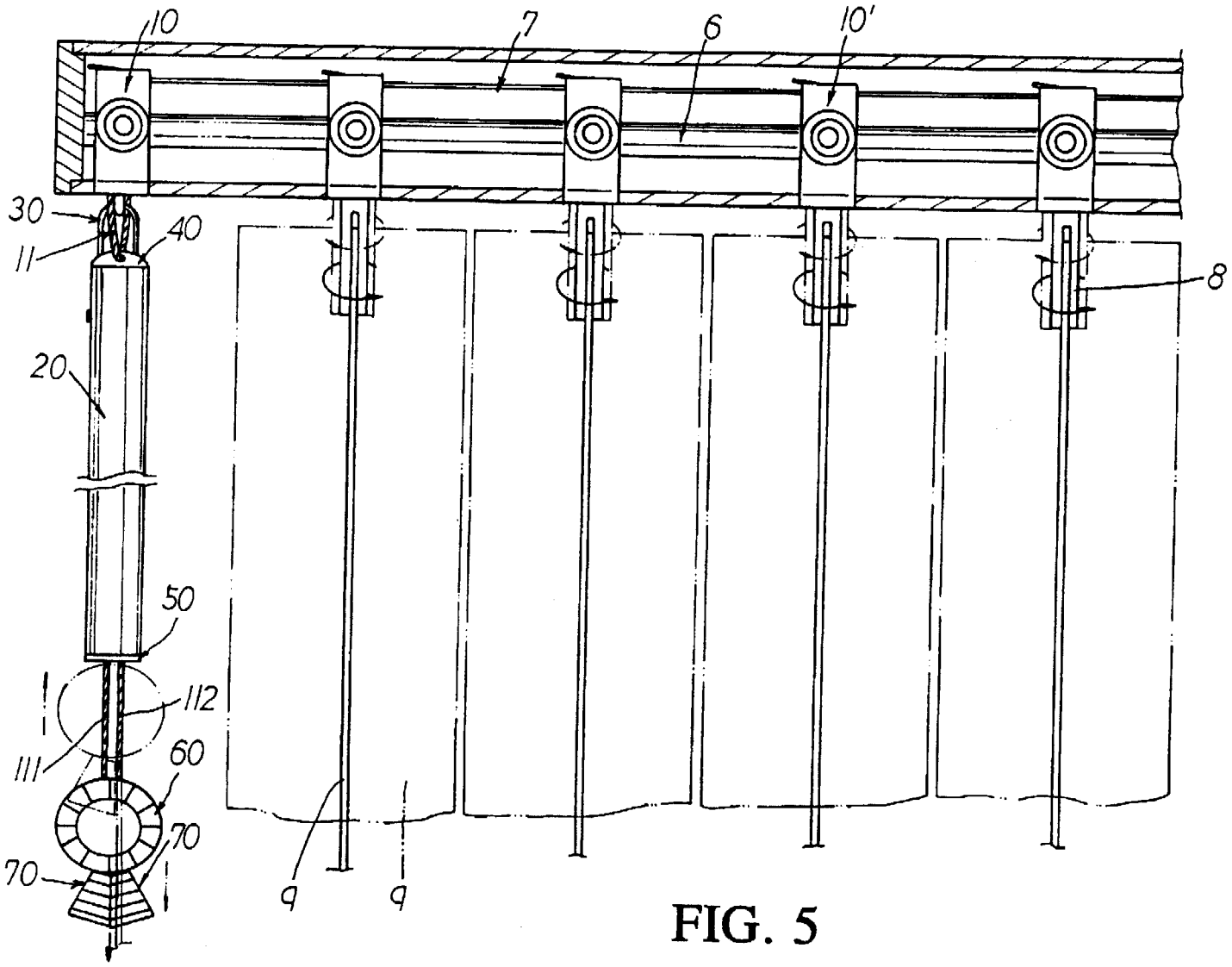
FIG. 5 is an assembled view of the present invention, showing the adjustment of the angle of the slats.

Please refer to FIG. 5. The angle of the slats 9 is adjusted for achieving best light (with each slat 9 facing the other) in such a manner that the adjustment block 60 is pulled downward to bring a conic sleeve 70 at a higher position into alignment with the conic sleeve at a lower position. Accordingly, both the top ends of the conic sleeves 70 are brought into a flush position. At this time, the guide cord 11 urges the shaft wheel 12 to rotate so as to rotarily drive the rotary bar 6. Simultaneously, the slats 9 clipped by the clip members 8 of all other pulley seats 10' are rotated to a face-to-face position normal to the window as shown by solid lines. On the other hand, the angle of the slats 9 can be adjusted for achieving best shading effect in such a manner that either of the two conic sleeves 70 is pulled downward, making the corresponding first or second end portion 111, 112 of the guide cord 11 simultaneously move downward. At the same time, the other conic sleeve 70 along with the corresponding second or first end portion 112, 111 of the guide cord 11 is pulled upward so as to move the adjustment block 60 until the top end thereof abuts against the lower end of the lower cock body 50. Accordingly, the guide cord 11 drives the shaft wheel 12 to clockwise or counterclockwise rotate so as to rotate the rotary bar 6. At this time, the slats 9 clipped by the clip members 8 of all other pulley seats 10' are rotated to a side by side position parallel to the window as shown by the phantom lines.

Figure 6:
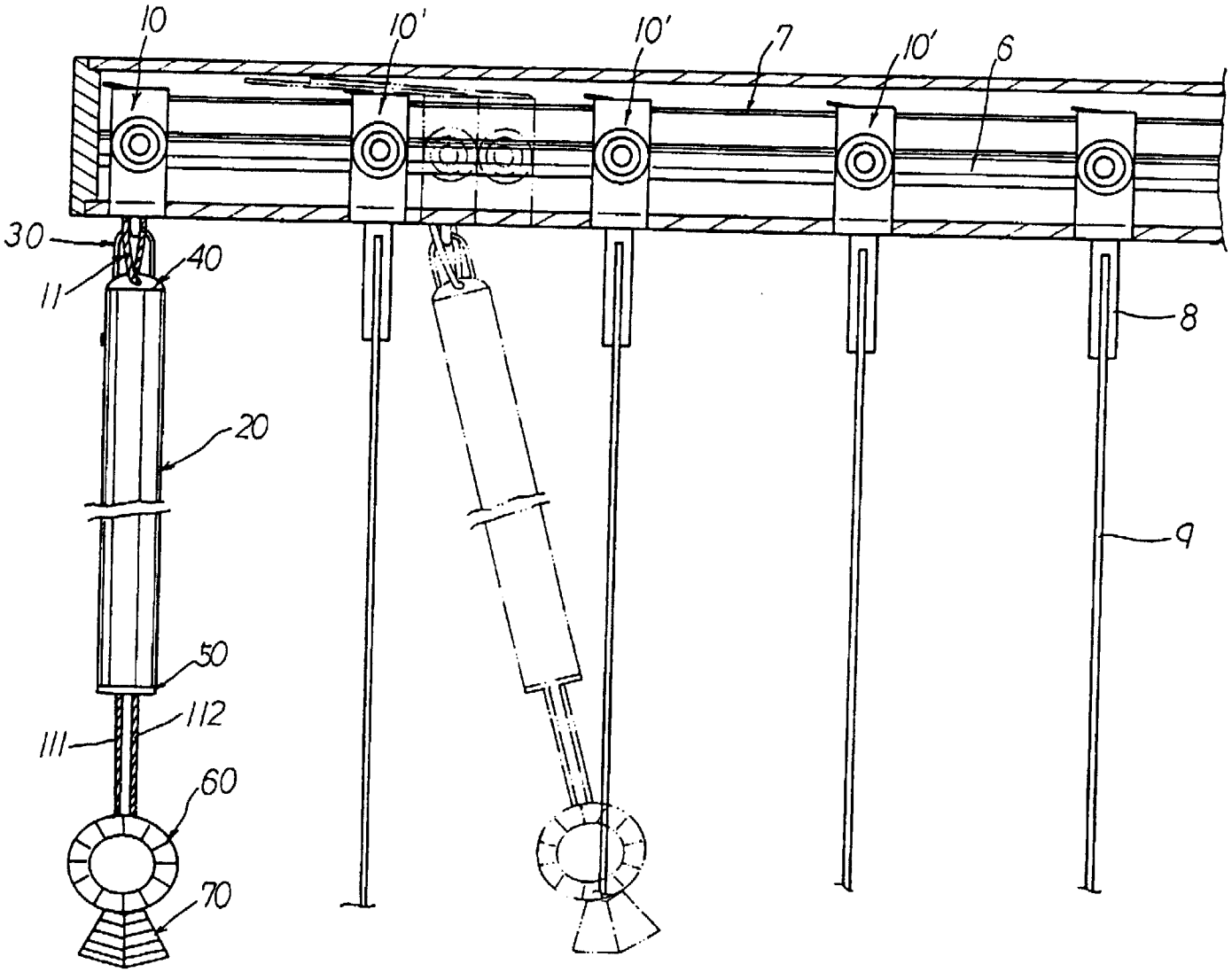
FIG. 6 is an assembled view of the present invention, showing the collection of the slats.

Please refer to FIG. 6. The slats 9 can be collected in such a manner that the adjustment block 60 is held and pulled in a collecting direction while it also automatically rotarily drives the shaft wheel 12 and the rotary bar 6 as described above. At this time, the slats 9 clipped by the clip members 8 of all other pulley seats 10' are automatically rotated by the rotary bar 6 to a face-to-face position and collected.

By means of the above arrangements, the present invention has the following advantages:

1. When not in the face-to-face position, by means of directly pulling the adjustment block in the collecting direction, the slats 9 of the blind can be automatically first rotated to the face-to-face position and then easily collected.

2. During the collecting operation, the slats are automatically rotated to the face-to-face position so as to avoid a slat being inserted into a clip member of an adjacent pulley seat to affect the collecting operation or damaging the slat.

3. The angle of the slats can be easily and quickly adjusted to open or close the blind by means of pulling the adjustment block or any of the two conic sleeves without distinguishing one from the other.

The above embodiment is only an example of the present invention and the scope of the present invention should not be limited to the example. Any modification or variation derived from the example should fall within the scope of the present invention.

What is claimed is:

1. An operating structure for a vertical blind, comprising an operative pulley seat, a guide cord, a shaft wheel, a hollow pull rod, a latch hook, an upper cock body, a lower cock body, an adjustment block, two conic sleeves, a screw, a hollow rotary bar and a distance-adjusting strip, a pair of shaft wheel holes being respectively disposed on two sides of the operative pulley seat, the shaft wheel being formed with a central rotary bar hole for the rotary bar to pass therethrough, each conic sleeve having a closed top end formed with a circular through hole and an open bottom end, the distance adjusting strip being fitted in distance adjusting slots formed on two sides of the pulley seat, said operating structure further comprising:

a hook ring and two through holes disposed on a rear side of a bottom face of the pulley seat;

the shaft wheel formed with two opposite fissures on two sides;

a locking hole formed on upper end portion of the hollow pull rod;

the latch hook being substantially U-shaped and having two inward bent latch legs at two ends;

the upper cock body being mushroom-shaped and having a head portion and a stem portion, the stem portion being formed with two opposite latch hook channels and two opposite guide cord channels, the latch hook channels extending upward to the head portion and the guide cord channels extending upward through the head portion, a latch hole and a fixing hole being formed through the stem portion between the opposite latch hook channels;

the lower cock body being T-shaped and having two guide cord through holes on a top face; and the adjustment block formed with two radial through holes, whereby when assembled, the guide cord is passed through the rotary bar hole of the shaft wheel by a length of the guide cord and then a first and a second end portion of the guide cord being engaged in the fissures of the shaft wheel, the guide cord being further wound on the shaft wheel, two ends of the shaft wheel being then rotatably fitted into the shaft wheel holes of the pulley seat, the first and second end portions of the guide cord being respectively and sequentially passed through the through holes of the pulley seat, the guide cord channels of the upper cock body, the hollow pull rod, the guide cord through holes of the lower cock body, the through holes of the adjustment block and circular through holes of the conic sleeves, then the first and second end portions of the guide cord being knotted and prevented from being withdrawn from the conic sleeves, the latch hook being then hooked on the hook ring of the pulley seat with the bent latch legs fitted into the latch hole of the upper cock body, then the upper cock body being fitted into the upper end of the pull rod with the fixing hole aligned with the locking hole thereof, the screw being screwed through the locking hole into the fixing hole of the upper cock body so that the upper cock body is secured in the upper end of the pull rod, then the periphery of the lower cock body being painted with an adhesive and fixedly plugged into the lower end of the pull rod.

* * * * *